United States Patent [19]

Sorenson

[11] 4,268,734

[45] May 19, 1981

[54] ENVIRONMENTALLY SEALED TOGGLE SWITCH

[75] Inventor: Richard W. Sorenson, Avon, Conn.

[73] Assignee: Carlingswitch, Inc., West Hartford, Conn.

[21] Appl. No.: 61,605

[22] Filed: Jul. 30, 1979

[51] Int. Cl.[3] ..... H01H 9/04; H01H 9/16

[52] U.S. Cl. ..... 200/302; 200/317; 200/315

[58] Field of Search ..... 200/302, 310, 315, 317, 200/68

[56] References Cited

U.S. PATENT DOCUMENTS

| | | | |
|---|---|---|---|
| 2,916,592 | 12/1959 | Campe | 200/302 |
| 2,927,983 | 3/1960 | Brown | 200/676 |
| 3,609,268 | 9/1971 | Sanchez | 200/315 |
| 3,701,870 | 10/1972 | Sorenson | 200/317 |
| 4,013,857 | 3/1977 | Tanaka | 200/315 |
| 4,191,873 | 3/1980 | Woodard | 200/302 |

FOREIGN PATENT DOCUMENTS

| | | | |
|---|---|---|---|
| 1336723 | 11/1973 | United Kingdom | 200/315 |

*Primary Examiner*—John W. Shepperd

*Attorney, Agent, or Firm*—McCormick, Paulding & Huber

[57] ABSTRACT

A toggle switch housing has an upwardly open base, a cover bracket secured to the base and a cover for a recessed upper portion of the cover bracket. The cover bracket recessed portion includes an upwardly projecting boss which pivotally receives an actuator, and the upper end of the actuator projects through the cover to define a toggle or bat. The cover may have one or more transparent panels to provide light from one or more miniature lamps mounted in small openings provided for this purpose in the cover bracket in order to provide an indication of circuit condition. The three-part switch housing provides an environmentally sealed space for the switch contacts, and for the electrical connections to the lamp.

6 Claims, 3 Drawing Figures

ENVIRONMENTALLY SEALED TOGGLE SWITCH

SUMMARY OF THE INVENTION

This invention relates generally to electric toggle switches, and deals more particularly with an environmentally sealed toggle switch housing wherein the electrically conductive fixed and movable contacts are isolated from environmental conditions in the area of the exposed manually movable portion of the switch actuator, or toggle.

The switch housing includes an upwardly open base for housing the movable and fixed switch contacts, and the base is preferably formed from a dielectric thermoplastic material such as nylon, or it may alternatively be formed of Bakelite. A cover bracket of similar material has integrally formed depending legs which engage recesses provided for this purpose in the base, and these legs define resilient upwardly projecting wings suitable for mounting the switch housing in a panel opening. The cover bracket has a rectangular recessed portion defining side walls, and side wall openings receive projecting portions of a cover. A central boss in the rectangular recessed portion of the cover bracket is adapted to receive a spherically shaped portion of the toggle actuator such that the upper or toggle end of the actuator can cause pivotal movement of the actuator on the axis defined by the fixed boss and the movable spherical portion of the actuator itself. One or more spring biased plungers on the lower end of the actuator engage the movable contact member or members, and a slot in the cover itself allows freedom of movement of the upper toggle portion of the actuator. Although contaminants may enter the switch housing through this slot in the cover, an impervious upper boundary is defined for the cavity containing the contact elements by the cover bracket itself, preventing these contaminants from entering the enclosed cavity for the switch contacts and lamp connection. The recessed portion of the cover bracket preferably includes means for mounting a conventional lamp or LED, and the cover itself may include a transparent lens panel above such a lamp.

DESCRIPTION OF THE PREFERRED EMBODIMENT

Figure 2:
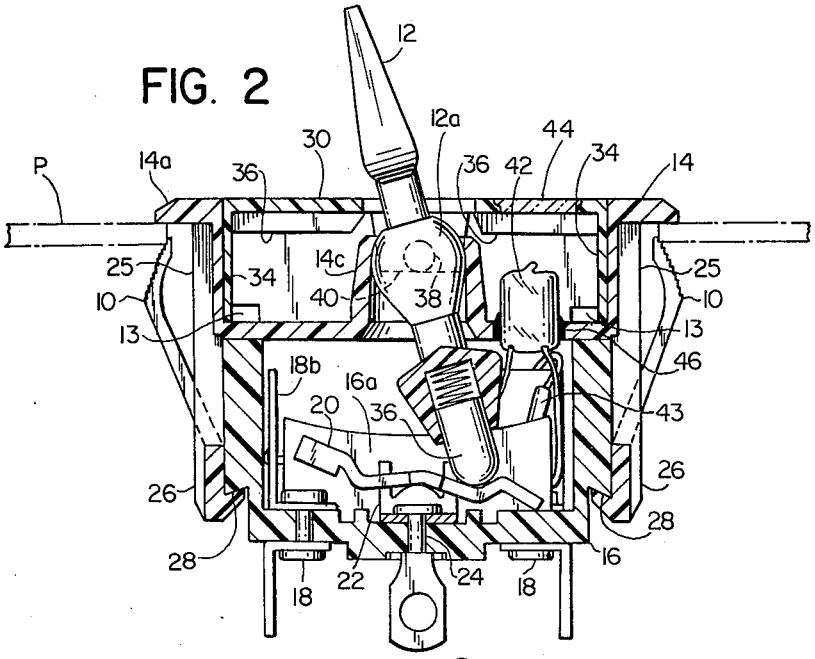
FIG. 2 is a sectional view taken generally on the line 2—2 of FIG. 3, with phantom lines to represent the panel in which the switch is adapted to be mounted.

Turning now to the drawing in greater detail, the switch of the present invention is intended to be secured in an opening provided for this purpose in a mounting plate or panel as suggested by the phantom lines P in FIG. 2, and the reader is referred to my prior U.S. Pat. No. 3,701,870 for a detailed discussion of the advantages to be gained by providing a switch housing of thermoplastic material such as nylon in order to provide integrally formed resilient wings as illustrated at 10, 10 so as to secure a switch housing in a panel opening. It should be noted that this prior U.S. Pat. No. 3,701,870, and prior art patents generally, suffer from the disadvantage that such a toggle switch configuration does not eliminate liquid contaminants from being introduced into the interior of the switch case or housing where the fixed and movable contact elements are provided. in prior art toggle switch configurations the actuator toggle generally does not fit tightly enough in its socket to prevent contaminants, particularly those of the liquid variety, from entering the interior of the switch housing, and such contaminants often deteriorate the contacts creating either a short circuit condition, or rendering the switch mechanism useless.

It is a feature of the present invention that the toggle 12 is provided in a recessed cover bracket 14, which bracket cooperates with an upwardly open base 16 such that the interior cavity for the electrical contacts, and other metal parts of the switch, will not be attacked by these contaminants.

Figure 3:
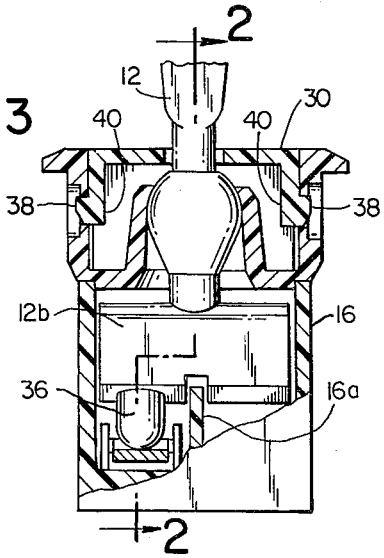
FIG. 3 is a sectional view with portions broken away being taken generally on the line 3—3 of FIG. 1.

As best shown in FIG. 3 the base 16 comprises an upwardly open plastic part which has parallel side and end walls, and which also includes a short center wall **16*a* integrally formed and connecting the opposite end walls to shield the contacts in a double pole type switch (not shown) and to prevent interference between the movable contact member and the leads associated with the lamp 42, to be described. The contacts provided in the lower wall or floor of the base 16 may be of conventional configuration and comprise studs 18, 18 secured in a conventional fashion to the floor of the housing 16 and adapted to provide a conductive path from outside of the switch housing to the contacts defined by the upper ends of these studs, as shown by way of example at 18*a* in FIG. 2. The movable bridging contact, or lever 20, is provided on a conductive yoke 22 held in the floor of the case 16 by a stud 24 such that the switch has two positions, the off position being shown in FIG. 2, and the on position being achieved when the lever 20 is moved into contact with the element 18*a*. Although the switch shown in the drawing comprises a two position on/off toggle switch, it will be apparent that other conventional switch configurations can be achieved by rearranging the fixed contacts and adopting other geometries for the movable bridging contact member. A detailed discussion of the operation of the contact elements is deemed to be unnecessary in view of the conventional aspects for this portion of the present disclosure. However, it is noted that the lamp 42 has associated leads, one of which is connected to an upwardly projecting post 18*b* associated with the stud contact 18*a* described previously, and the other lead being connected to a stud 18 (not conductively associated with the movable member 20) but provided merely to complete the circuit for the lamp 42. A resistor 43 is provided in the lamp circuit and is also a conventional electrical component in illuminated switches generally. It is noted however that the integral wall 16*a* of the switch base 16 serves, in the switch configuration shown in FIG. 2, to provide a convenient separation between the leads for the lamp 42 and the movable contact member 20**.

Figure 1:
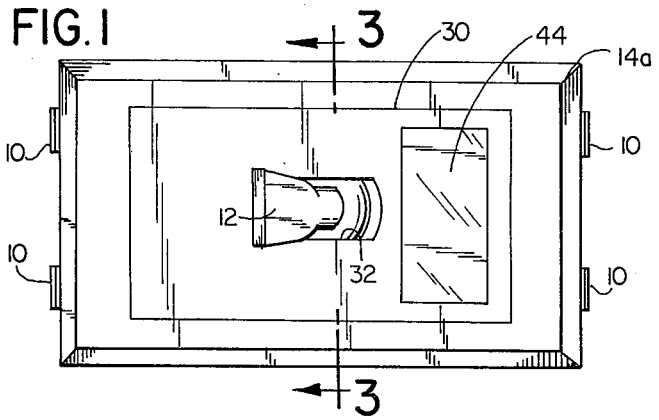
FIG. 1 is a top plan view of a toggle switch constructed in accordance with the present invention.

Turning now to a complete description of the cover bracket 14, FIG. 1 and FIG. 2 show this part to be of generally rectangular configuration, slightly larger in size than the rectangular base upon which it fits and having depending resilient legs 26, 26 which legs have inturned end portions for securing the cover bracket 14 to the base 16 by means of the recesses 28, 28 provided for this purpose adjacent the lower side portions of the base. These depending legs 26, 26 each include a center bar 25 which is integrally connected to the upper portion of the cover bracket 14, and each leg 26 also includes spaced wings 10, 10 as described above. Thus, two wings 10, 10 are provided on either end of the cover bracket 14 and the bar 25 is located between these wings to provide an inverted T-shaped configuration (not shown) for the resilient legs 26 and 26 at either end of the cover bracket 14.

The cover bracket 14 further includes an upwardly open rectangular receptacle or cavity, to define a recessed portion or floor located in spaced relationship below the flanged peripheral portion 14*a*. This flanged portion 14*a* engages the panel P when the switch is mounted in a panel as shown in FIG. 2. The recessed portion of the cover bracket 14 is deep enough so that it accommodates a lamp such as shown at 42, and so as to define an integrally molded upstanding boss 14*c*, which boss has an inturned lip at its upper end to snugly receive the spherial portion 12*a* of the actuator toggle 12. Thus, the actuator toggle sealingly, and snugly engages the upper end or lip of the boss 14*c*. A wear resistant seal is thus provided as a result of the inturned peripherally extending lip, on the upper end of said boss engaging the spherical shoulder 12*a* of actuator toggle 12. The actuator includes an enlarged lower portion 12*b* closely fit to the case to restrict the actuator to pivotal motion in one plane. This portion 12*b* of actuator 12 defines at least one cavity for slidably receiving a spring biased plunger 36, which plunger has a lower portion for engaging the movable contact bridging member 20. The actuator 12 is held in the position shown by this spring biased plunger and it will be apparent that the force of the plunger spring acting upwardly on the actuator, and indirectly on the lip of boss 14*c*, provides a very effective seal even when the switch is subjected to long periods of use such as might tend to wear these pivot defining portions of the actuator shoulder 12*a* and boss 14*c*.

Unlike prior art toggle switch configurations the cavity where the switch contacts and lamp connections are made is very effectively sealed from the outside environment of the switch housing itself. If liquid should be allowed to run into the recessed portion of the cover bracket none will penetrate the interior of the switch housing due to the spherical pressure seal between pivot defining members 14*c* and 12*a*. Any liquid reaching the recessed portion surrounding boss 14*c* may be drained outside the switch assembly through optional ports 13. The lamp 42 is preferably potted in a small opening in the floor of cover bracket 14 as shown at 46.

The generally rectangular recess of the cover bracket 14 is adapted to be covered by a lid or cover 30. The cover 30 has a central opening or slot 32 adapted to loosely receive the upstanding, manually engageable portion, of the actuator 12. This cover has depending legs 34, 34 at oposite ends thereof so that the rectangular cover 30 can be snugly received in the rectangular recess of the cover bracket 14. Locating flanges 36, 36 are also provided along the marginal edges of cover 30 for locating the cover laterally in the rectangular recess of the cover bracket 14. The cover 30 is preferably held in the cover bracket 14 by means of laterally outwardly projecting tabs 38, 38 provided at the lower end of depending flange portions 40, 40 on the cover 30. These projecting tabs 38, 38 are adapted to be received in aligned openings provided for this purpose in the wall portion of the cover bracket as best shown in FIG. 3.

Finally, and still with reference to the cover 30 a transparent lens 44 is mounted in a suitable opening provided for this purpose in the cover, and preferably immediately above the lamp 42 so as to provide a convenient indication of switch condition. The lamp 42 is potted or otherwise held in an opening in the floor of the cover bracket 14 as indicated generally at 46 in FIG. 2 with the result that the panel mounted toggle switch is given a flush exterior appearance resulting from the rectangular cover 30 held in the cover bracket 14 with only the slot 32 in the cover interrupting the smooth face or top of the switch housing assembly. Whereas prior art toggle switch housings generally include an unsightly threaded boss or barrel, the toggle switch described herein provides a cleaner design, less susceptible to contamination and deterioration of its internal conductive components. The cover 30 can be conveniently snapped into position at assembly and the actuator 12 will not tend to become loose in its associated socket so as to provide an opening for the entry of contaminants into the interior of the switch housing itself.

I claim:

1. An electric switch housing for protecting the fixed contacts and movable contact bridging member from environmental conditions external to the switch, said housing comprising an upwardly open dielectric base for said contacts and bridging member, a dielectric cover bracket secured to said base for isolating the contents of the base from the environment, said cover bracket having a recessed portion and a generally cylindrical upstanding boss defined centrally of said recessed portion, an actuator snugly received in a central opening of said boss and having a shoulder portion engaging an inturned lip on said boss, an inner end of the actuator adapted to engage the movable contact bridging member and an upper end of said actuator projecting above the lip of said boss and defining a toggle, said cover bracket having a raised peripherally extending wall portion with openings therein, a cover with depending flanges defining laterally projecting tabs received in said openings, said cover having a center opening for receiving said upwardly projecting toggle of said actuator, and said cover providing a lid for said recessed portion of said cover bracket.

2. The switch housing of claim 1 wherein said generally spherical portion of said actuator toggle is snugly received in a complementary shaped upper end of said boss defined by said lip to define a pivot axis for said actuator.

3. The switch housing of claim 1 wherein said recessed portion of said cover bracket is of generally rectangular configuration and said cover also having generally rectangular configuration, at least one opening in said recessed portion of said cover bracket alongside said boss to receive a small electric lamp, and at least one lens provided in a lens opening defined by said cover.

4. The switch housing of claim 2 wherein said actuator includes a lower portion having at least one plunger slidably received in a downwardly open recess, and biasing means acting between said plunger and said actuator, said actuator having an intermediate portion so shaped that it cooperates with the interior of said base to restrict the actuator to pivotal movement in one plane about said spherical portion of said actuator.

5. The switch housing of claim 4 wherein said cover has depending resilient legs which cooperate with the wall portion of said cover bracket to locate said cover in said rectangular cover bracket recess.

6. The switch housing of claim 4 wherein said cover bracket has integrally formed depending legs at opposite ends thereof, which legs cooperate with recesses in said base to secure said base to said cover bracket, and said legs having integrally formed wings to engage the underside of a panel in which the switch is to be mounted, said cover bracket having flanged portions spaced from the free ends of said wings to engage the front side of the panel to hold the switch housing in a panel opening.

* * * * *